US005704193A

United States Patent [19]

Roe et al.

[11] Patent Number: 5,704,193

[45] Date of Patent: Jan. 6, 1998

[54] CONTAINER FOR SHIPPING AND DISPLAYING ARTICLES, AND METHOD FOR MAKING

[76] Inventors: Quentin J. Roe, 2930 Crystal Beach Rd., Winter Haven, Fla. 33880; Thomas S. Ruggiere, Sr., 215 Tanglewood, Athens, Ga. 30605

[21] Appl. No.: 542,004

[22] Filed: Oct. 12, 1995

[51] Int. Cl.[6] ..... B65D 85/34

[52] U.S. Cl. ..... 53/397; 40/312; 53/456; 206/459.5; 206/509; 206/775; 229/117.16; 229/120; 229/125.33; 426/118

[58] Field of Search ..... 53/397, 411, 415, 53/416, 449, 456, 457, 471; 40/312; 206/459.5, 509, 775; 220/367.1, 370, 372; 229/117.13, 117.16, 117.17, 118–120, 125.03, 125.13, 125.19, 125.21, 125.33–125.36, 164, 125.01; 426/106, 112, 118, 124, 392, 395

[56] References Cited

U.S. PATENT DOCUMENTS

| | | | |
|---|---|---|---|
| 2,065,150 | 12/1936 | O'Brien . | |
| 2,163,117 | 6/1939 | Evans et al. . | |
| 2,285,731 | 6/1942 | Magley . | |
| 2,665,836 | 1/1954 | Rendall . | |
| 2,675,166 | 4/1954 | Main . | |
| 2,690,285 | 9/1954 | Main . | |
| 2,963,211 | 12/1960 | Agler . | |
| 3,002,672 | 10/1961 | Kotowick . | |
| 3,040,961 | 6/1962 | Meyers . | |
| 3,109,579 | 11/1963 | Crane | 229/125.36 |
| 3,425,544 | 2/1969 | Ayer et al. | 229/164 |
| 3,648,833 | 3/1972 | Dash | 40/312 |
| 4,389,013 | 6/1983 | Hall et al. | 206/509 |
| 4,418,863 | 12/1983 | Kimbrell, Sr. | 229/120 |
| 4,513,907 | 4/1985 | Grosshuesch . | |
| 4,702,409 | 10/1987 | Osborne . | |
| 4,770,339 | 9/1988 | Weimer | 206/509 |
| 5,458,899 | 10/1995 | Floyd et al. | 426/395 |

FOREIGN PATENT DOCUMENTS

| | | | |
|---|---|---|---|
| 500436 | 8/1992 | European Pat. Off. | 206/459.5 |
| 2302254 | 9/1976 | France | 220/370 |
| 4102166 | 7/1992 | Germany | 206/509 |

*Primary Examiner*—Jimmy G. Foster
*Attorney, Agent, or Firm*—Allen, Dyer, Doppelt, Milbrath & Gilchrist, P.A.

[57] ABSTRACT

A container for shipping and displaying articles is formed from a continuous, foldable sheet of corrugated boxboard to form a container body having a bottom, enclosing end and side walls attached with and extending generally normal from the bottom and a partially enclosed top panel opposite the bottom and adjacent each end wall with a substantial portion of the top being open. The container is filled with articles to be shipped and displayed and a netting member having an open weave is stretched across the open portion of the top and between the panels, with opposing ends of the netting member fixed to the sides of the container body with a header sheet adhesively fixed to the container sides and with an advertising message printed on the outside of the header sheet. Interlocking stacking tabs and handle recesses are provided for use with multiple containers of the same construction.

41 Claims, 4 Drawing Sheets

CONTAINER FOR SHIPPING AND DISPLAYING ARTICLES, AND METHOD FOR MAKING

BACKGROUND OF INVENTION

The present invention relates generally to containers for shipping and displaying articles and methods for making such containers, and in particular relates to a container having an open top covered by a protective netting and which is useful in shipping and displaying perishable agricultural products such as fruits and vegetables.

There are a number of prior art containers that are useful for both shipping and then displaying perishable products at the point of sale, for example in a supermarket. One such prior art arrangement is fabricated from wooden slat material, with extended ends and a netting member across an open top which is stapled to the opposing wooden side walls. Other prior art shipping and display containers are made from flat blanks of corrugated boxboard (also referred to as cardboard). Examples of such arrangements are disclosed in the following United States Patents: U.S. Pat. No. 4,702,409 to Osborne; U.S. Pat. No. 4,513,907 to Grossheusch; U.S. 3,040,961 to Meyers; U.S. Pat. No. 3,002,672 to Kotowick; U.S. Pat. No. 2,963,211 to Agler; U.S. Pat. No. 2,690,285 to Main; U.S. Pat. No. 2,675,166 to Main; U.S. Pat. No. 2,665,836 to Rendall; U.S. Pat. No. 2,285,731 to Magley; U.S. Pat. No. 2,163,117 to Evans et al; and U.S. Pat No. 2,065,150 to O'Brien.

SUMMARY OF INVENTION

The present invention comprises a container for shipping and displaying articles, and a method for making the container. The method contemplates the step of forming a container body having a bottom, enclosing end and side walls attached with and extending generally normal from the bottom, and a top opposing the bottom which is at least partially open; the bottom and the end walls and side walls together define an enclosure into which are placed the articles which are to be shipped and displayed. A netting member is provided having a width dimension adapted to extend across the open portion of the top and a lengthwise dimension between the lengthwise ends which permits the netting member to extend across the open portion of the top and along the opposing outside faces of the side walls. In accordance with the present invention, each lengthwise end of the netting member is fitted with a header sheet, with each header sheet being fixed to one of the outside faces of the opposing side walls after the container is filled with the articles to be shipped and displayed, in order that the netting member tightly fits over the open top and thereby retains the articles being shipped and displayed within the enclosure. The header sheet may be fixed and attached to a corresponding outside face of a side wall by applying an adhesive layer between each header sheet and the respective outside face. In a preferred form, this is achieved by applying a first adhesive layer between a netting end retention sheet and an inside surface of the header sheet, with one lengthwise end of the netting member therebetween. The first adhesive layer is permitted to dry and then a second layer of adhesive is applied between the netting end retention sheet and the outside face of the adjacent wall (after the container has been filled with the articles to be shipped and displayed). The header sheet has a sufficient length and width to permit the printing of an advertising message on the outside surface thereof.

Further in accordance with a preferred embodiment of the method of the present invention, the container is fabricated from a continuous foldable sheet of corrugated boxboard which is folded and bent to form the container body so as to have the bottom, enclosing end and side walls and the partially open top, with the end walls and adjacent outer extremities of the side walls extending to a greater dimension from the bottom than the dimension of a central portion of the side walls, with a partially enclosing top panel extending across the end walls and between the opposing outer extremities of the side walls. In a specific form, the central portion of the side walls is defined by a central cut-out portion at the upper extremity of each side wall, with the netting member dimensioned to fit only in the elongated central cut-out portion across the open top of the container body.

Suitably, the sheet of corrugated boxboard further includes a generally "C"-shaped cut portion at the upper extremity of each end wall panel, with the uncut portion forming a stacking tab; likewise, each end wall panel includes a generally "D"-shaped cut at the bottom thereof, which forms a handle opening adjacent the bottom of the container. Preferably, the "D"-shaped cut extends partially along the bottom panel, so that when the container is erected, the stacking tab of one container fits into the "D"-shaped cut of a container stacked on top of the first container.

In accordance with the present invention, the foldable sheet of corrugated boxboard is also provided with overlapping reinforcing panels, including panels which extend along the outer extremities of the side walls and, in one specific form, include tabs which are engaged in corresponding slots at the bottom of each side wall. Alternatively, the reinforcing panels along the outer extremities of each side wall may be adhesively joined to the outside face of the corresponding side wall. Each side wall and the adjacent reinforcing panel is provided with a recess at each extremity of the corresponding side wall central portion for receiving the sides of the netting member.

The resulting container provides a low cost, facile construction for rapidly shipping and displaying perishable agricultural products, especially fresh citrus fruit. The header sheet construction permits the netting member to be rapidly attached to the container body using automated or semi-automated techniques, and also provides a surface across which an advertising medium may be displayed in an attractive manner. The handle recess/stacking tab construction permits an arrangement which reduces damage to perishable fruits during shipping and display. Additionally, the dimensional relationship between the height of overall container and the central portion of the side wall is specifically selected to allow sufficient space so that an agricultural product in the container (citrus fruit, for example) is not in contact with the bottom of a container stacked thereon, and which allows cross-circulation of air, preventing gas buildup around the fruit. This also permits a faster cool-down in refrigerated areas.

Other benefits and features of the present invention will be evident from the drawings and the following detailed description.

THE DRAWING

Figure 1:
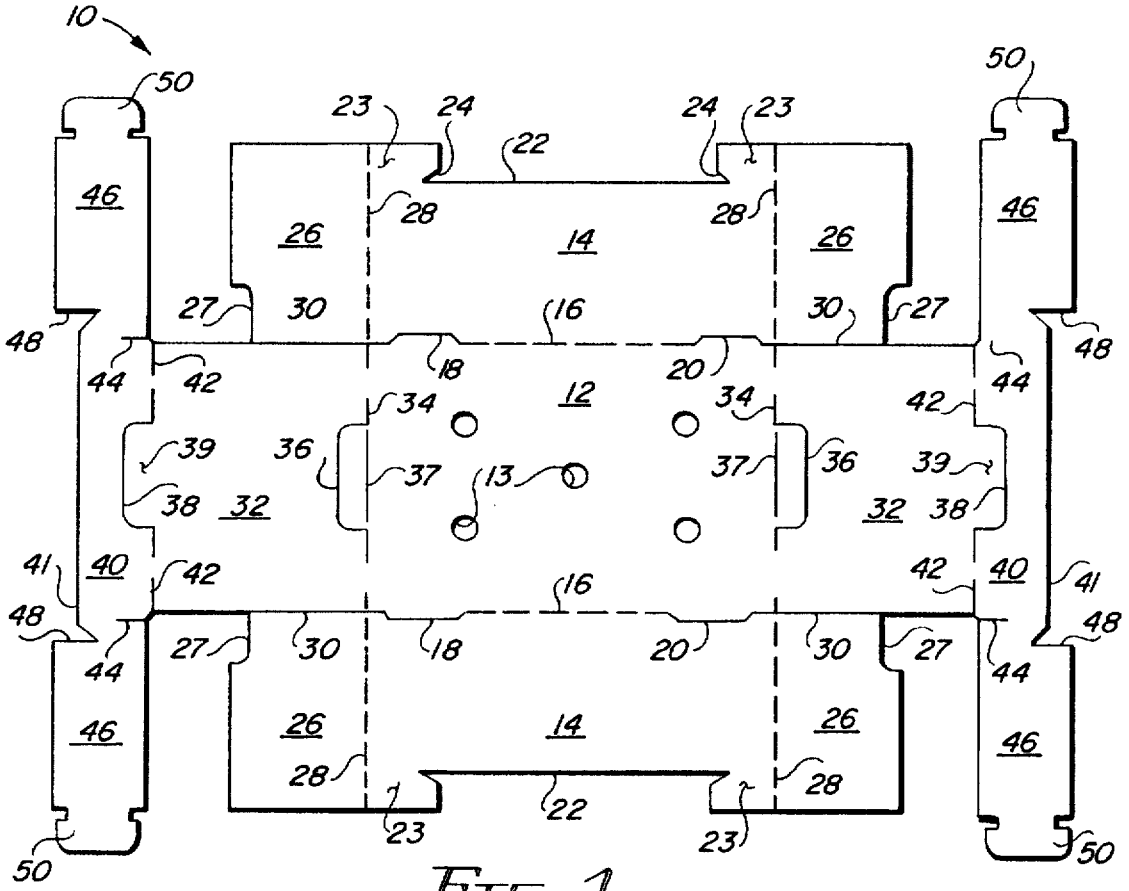
FIG. 1 is a top plan view of a foldable sheet of corrugated boxboard useful in forming the container of the present invention, in which solid lines represent cuts, and dotted lines represent fold lines.
Figure 4:
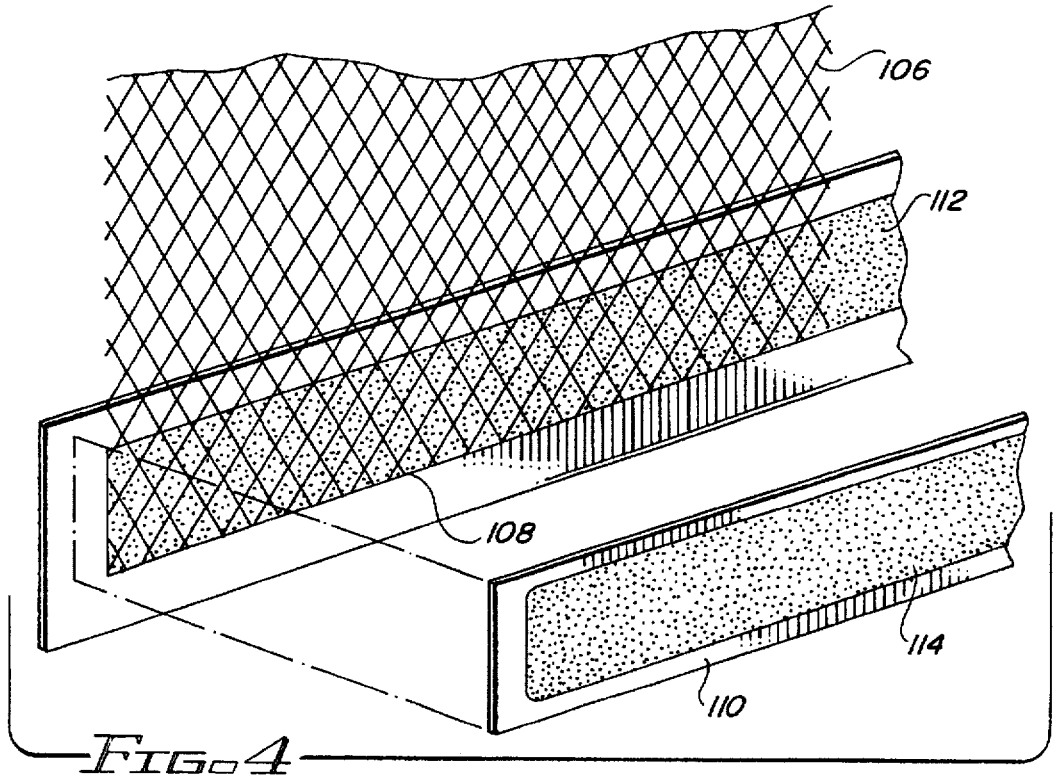
FIG. 4 is a perspective illustration of one step in the construction of the header member shown in FIG. 3.
Figure 2:
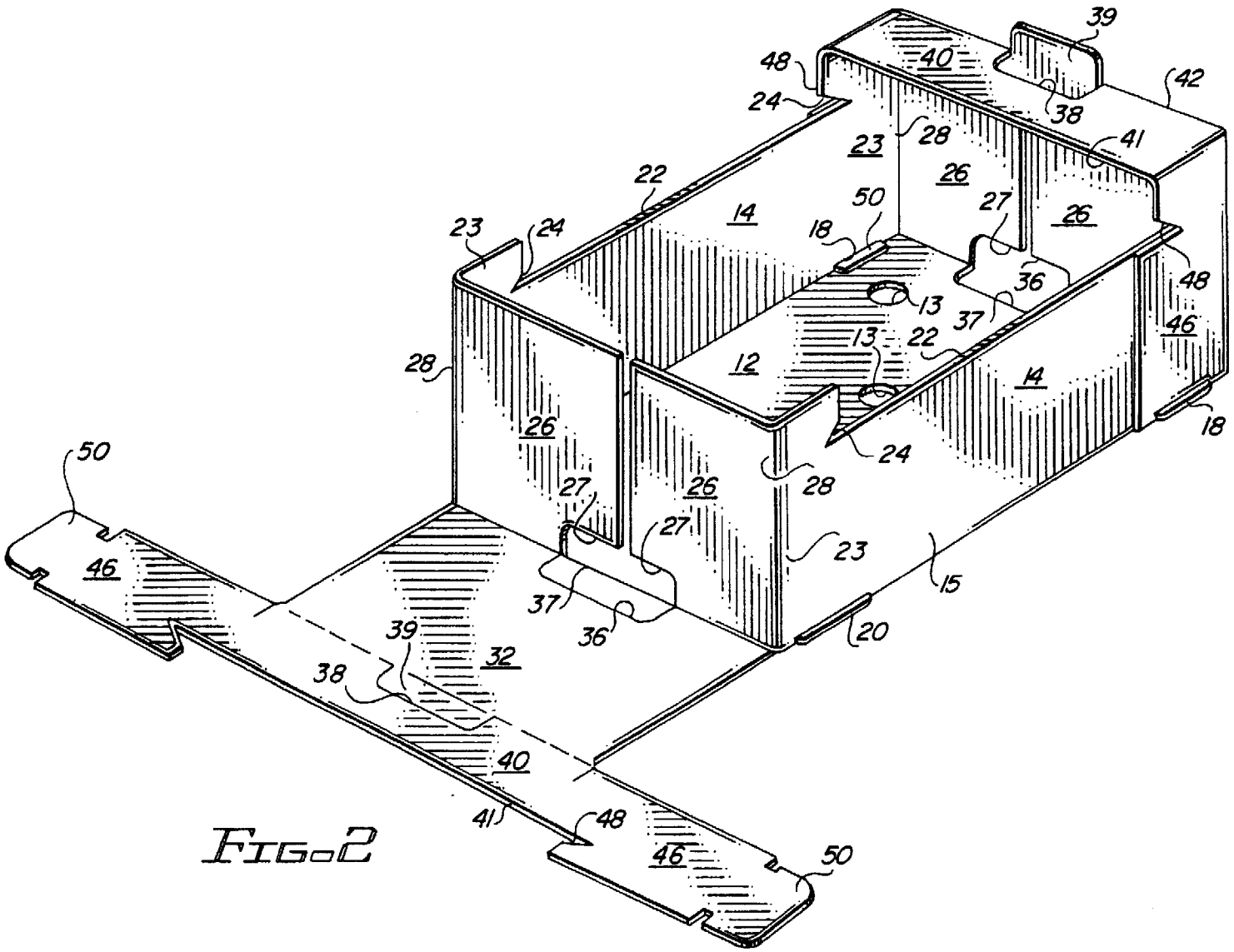
FIG. 2 is a perspective view of the container of the present invention partially assembled from the corrugated boxboard sheet of FIG. 1.
Figure 3:
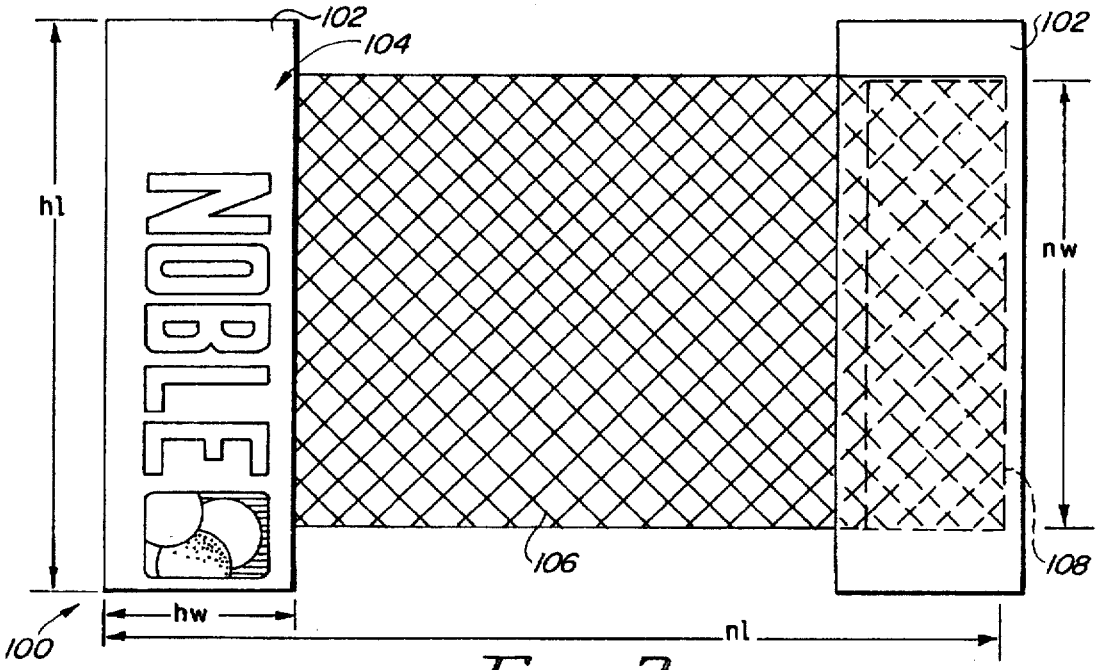
FIG. 3 is a top plan view of a netting member in accordance with the present invention, with dotted lines used to represent portions of the construction more clearly illustrated in FIG. 4.
Figure 5:
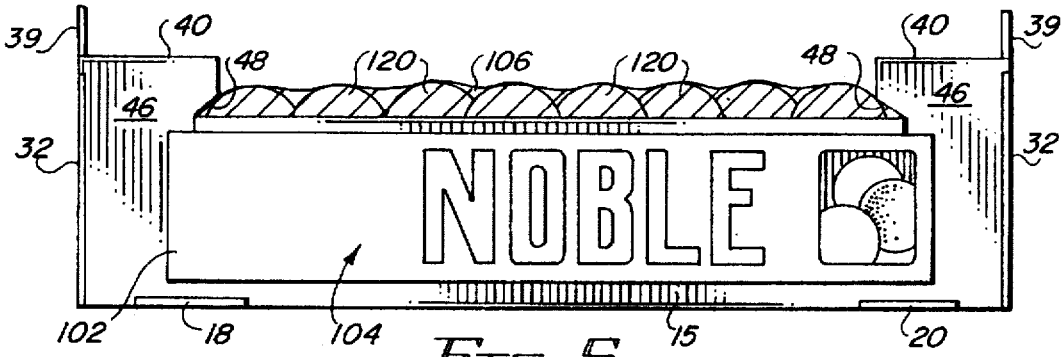
Figure 6:
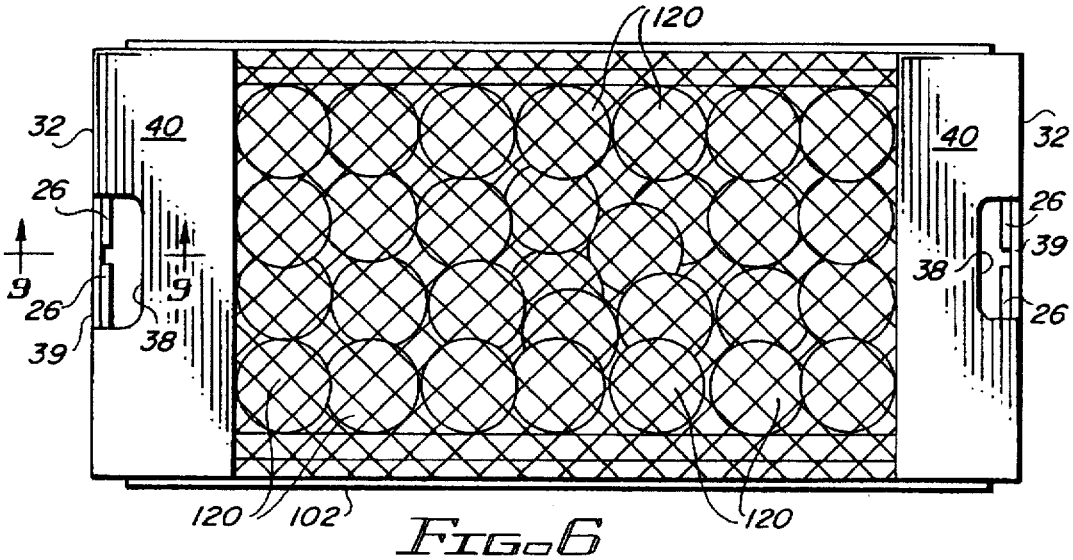
Figure 7:
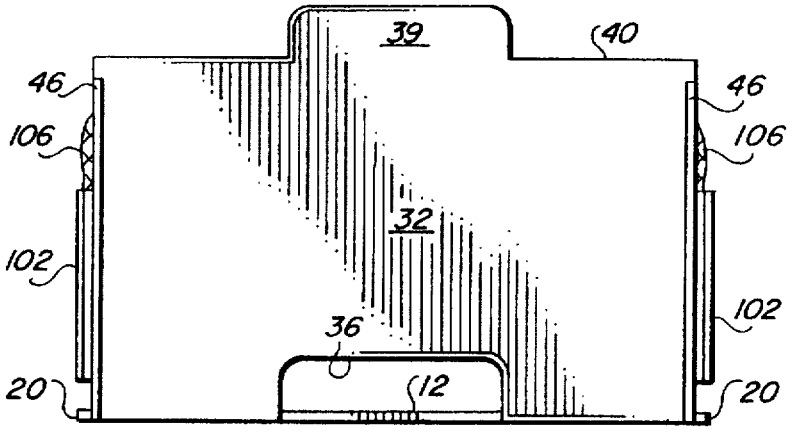
Figure 9:
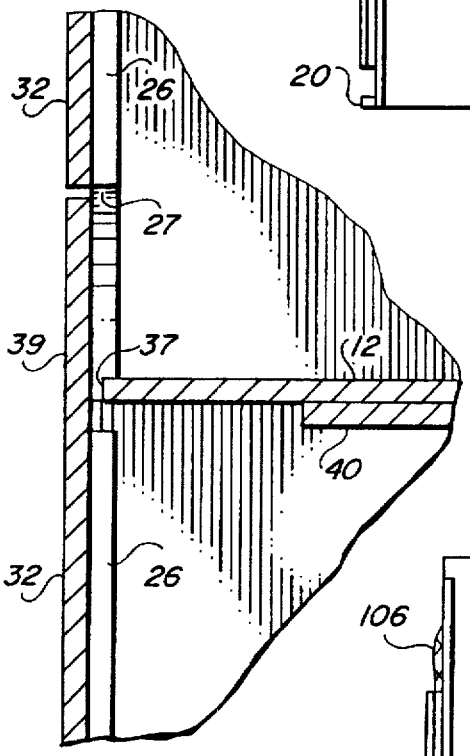
Figure 8:
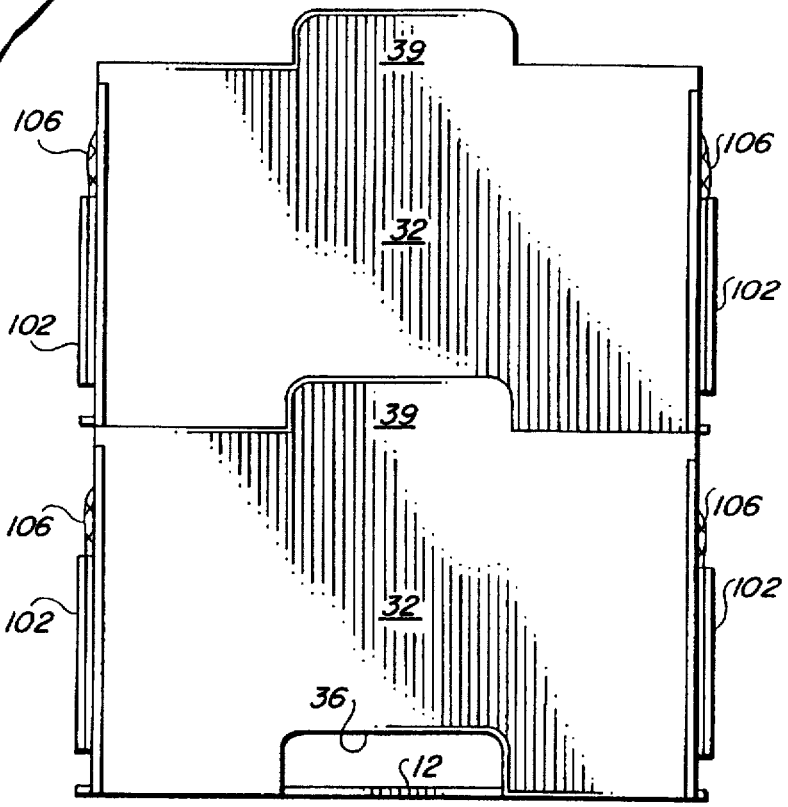

FIGS. 5, 6 and 7 are side, top and end views, respectively, of an assembled shipping and display container with netting member using the boxboard sheet of FIGS. 1 and 2, and the netting member of FIGS. 3 and 4;

FIG. 8 is an end view similar to that of FIG. 7, illustrating the manner in which two containers of the present invention are stacked together; and FIG. 9 is an enlarged cross sectional view taken along the line 9—9 in FIGS. 5 and 6, and in which two containers are shown stacked one on top of the other.

DETAILED DESCRIPTION

A detailed description of the preferred embodiment of the container and method of the present invention will now be described with reference to FIGS. 1–9.

The display and shipping container of the present invention comprises two principal parts: the container body which is illustrated and described with reference to FIGS. 1, 2 and 5–9; and the netting member/header construction, which is specifically shown in FIGS. 3 and 4, and shown together with the container body in FIGS. 5–8.

Noting FIG. 1, there is provided a continuous, foldable sheet of corrugated boxboard, referred to generally by the reference numeral 10. The sheet 10 includes various panels and fold lines which are shown as dotted lines in FIG. 1. The sheet defines a bottom panel 12 having ventilation holes 13 therein, and adjacent side walls 14 attached to the bottom panel 12 via fold lines 16. The sheet 10 further includes slots 18, 20 at the intersection between the bottom panel 12 and each side wall panel 14 which are dimensioned to receive locking tabs 50 as described further below with reference to FIG. 2. Each side wall panel 14 is defined by a central portion 22 which is cut out from the panel, and recesses 24 at the sides of the central, cut out portion 22. Each sidewall panel 14 thus defines an outer extremity 23 which has a greater dimension between the bottom panel 12 and the top of the container than does the central portion 22. Reinforcing panels 26 are attached along fold lines 28 on each extremity of each side wall panel 14, and is separated from the adjacent side wall by a fold line 28. Each reinforcing panel 26 includes a handle cut out 27 which will be further illustrated below. Each reinforcing panel 26 is separated by a cut 30 from the adjacent end panels 32.

Each end panel 32 is attached to the bottom panel 12 with an intermediate fold line 34. Each end panel 32 further includes a generally "D"-shaped handle cut out 36 with a portion of the cut 37 extending into the bottom panel 12, to provide a recess for a stacking tab 39, as will be illustrated in greater detail below with reference to FIGS. 8 and 9. The stacking tab 39 is formed of an uncut portion of a generally "C"-shaped cut 38 at the outer extremity of each end wall panel 32 (and which becomes the upper extremity of the end panel after the carton is erected).

In accordance with the preferred form of the construction of the present invention, the sheet 10 defines a partial top panel 40 separated from the outer (upper) extremity of each end wall panel 32 by the cut 38 and fold line 42. Each partial top panel 40 has an overlapping reinforcing panel 46 attached thereto via a fold line 44, which, upon erection of the container extends along a corresponding extremity 23 of an adjacent side wall 14 (note FIG. 2). The tab 50 is formed at the outer extremity of each overlapping reinforcing panel 46, and is dimensioned to extend into a corresponding one of the slots 18, 20 of the side walls 14 upon erection of the container. In an alternate arrangement, it will of course be understood by those skilled in the art that the overlapping reinforcing panels 46 may be adhesively bonded to the outer extremities 23 of the side walls 14 to thereby avoid the necessity for the tabs 50 and the associated slots 18, 20. However, in certain instances the tab-slot arrangement shown in FIGS. 1 and 2 may provide distinct advantages during fabrication of the containers.

With continuing reference to FIG. 1, each partial top panel 40—overlapping reinforcing panel 46 construction further includes a central portion 41 of lesser dimension from the upper extremity of the end wall 32 than the wider dimension of a corresponding overlapping reinforcing panels 46, with recesses 48 in that central portion which, upon folding of the container, coincide with the corresponding recesses 24 in the side walls 14 as shown in FIG. 2.

FIG. 2 illustrates the container in a partially erected form, with tabs 50 extending into corresponding slots 18 at the bottom of side walls 14 and with the recesses 24, 48 being juxtapositioned relative to each other by virtue of the folding of the overlapping reinforcing panels 46 across the outside face 15 of each side wall 14 across the outer extremity portion 23 thereof. (It will of course be understood that the tabs 50 shown at the lower, left hand end of the container in FIG. 2 are inserted in the slots 20 after the top panel 40 and overlapping reinforcing panels 46 are folded into place.)

The construction of the netting member 100 is shown and described with reference to FIGS. 3 and 4. The netting member 100 includes a length of open weave netting 106 having a net width nw corresponding to the dimension between the extremities of the recesses 24, 48 and the central portion of the side wall panels 14. Each length of netting 106 has lengthwise ends 108 defining a net length nl therebetween. The net length is sufficient to permit the net 106 to extend across the open portion of the top between the top panels 40 (FIGS. 2 and 6) and extend along the outside face 15 of each side wall 14. Each netting member 100 further includes a pair of header sheets 102, each of which has a header width hw and a header length hl sufficient to permit the printing of an advertising message 104 on the outside face thereof, with one of the lengthwise ends 108 of the netting 106 adhesively fixed to the inside face of a header sheet 102. As shown in FIG. 4, this is preferably accomplished by applying a first adhesive layer 112 between the netting and retention sheet 110 and the inside face of the header sheet 102 with a lengthwise end 108 of the netting 106 therebetween. After the first adhesive layer has dried, each netting member 100 may then be attached across the outside face 15 of a corresponding side wall 14 by applying a second adhesive layer 114 to the netting and retention sheet 110; that second adhesive layer is at least between the header sheet assembly (including the net retention sheet 110) and the outer face of each overlapping reinforcing panel 46, to insure that the ends of each header sheet are not loose and thus easily torn away from the container.

Side, top and end views of the assembled container-net member construction are shown in FIGS. 5, 6 and 7, respectively, with fruit 120 shown packed in the container illustrated in FIGS. 5 and 6. It should be noted that the netting 106 of the netting member 100 is sufficiently wide to extend into the recesses 48 of the overlapping reinforcing panels 46 (and the recesses 24 of the side panels as well).

The height of outer extremities 23 of the side walls 14 relative to the height of the central portion 22 is specifically selected so that the fruit 120 does not extend much above the central portion (as shown in FIG. 5), and the outer extremities permit sufficient cross-ventilation of air to prevent excessive buildup of the ethylene gas frequently used in processing fresh fruit. By way of example, certain varieties of fresh tangerines have reasonably consistent dimensions for which an overall container height of about 4 inches and a central portion height of about 3 inches are suitable.

The manner in which the stacking tab 39 of each container is adapted to fit within the handle recess 36 of a next adjacent container is illustrated in FIG. 8; it will be appreciated by those skilled in the art that this arrangement prevents sliding of the containers during shipping and while the products are being displayed, thereby diminishing significantly the potential for damage to the articles being shipped and eventually displayed. An enlarged cross-sectional view of this interlocking relationship is shown in FIG. 9.

This concludes the description of the preferred embodiments. A reading by those skilled in the art will bring to mind various changes without departing from the spirit and scope of the invention. It is intended, however, that the invention only be limited by the following appended claims.

What is claimed is:

1. A method for making a container for shipping and displaying articles, the method comprising the steps of:

forming a container body having a bottom, enclosing end and side walls attached with and extending generally normal from the bottom and a top opposing the bottom which is at least partially open, the bottom and the end walls and side walls defining an enclosure into which are placed the articles which are to be shipped and displayed;

providing a netting member having a width dimension extending across the open portion of the top and lengthwise ends dimensioned to extend across the open portion of the top and along an outside face of two opposing side walls;

filling the container with the articles to be shipped and displayed;

attaching a header sheet to each lengthwise end of the netting member; and fixing each header sheet to one of the outside faces of the two opposing side walls.

2. The method recited in claim 1 wherein the header sheet fixing and attaching steps comprise applying an adhesive layer between each header sheet and the outside face of the corresponding side wall.

3. The method recited in claim 2 wherein the adhesive layer applying step comprises the steps of:

applying a first layer of adhesive between a netting end retention sheet and an inside surface of the header sheet with one lengthwise end of the netting member therebetween;

permitting the first adhesive layer to dry; and then applying a second layer of adhesive between the netting end retention sheet and the outside face of the adjacent side wall.

4. The method recited in claim 3 wherein the second layer applying step comprises the step of applying adhesive to any portion of the inside surface of the header sheet not covered by the netting and retention sheet.

5. The method recited in claim 1 further comprising the step of printing an advertising message on an outside surface of each header sheet prior to the attaching and fixing steps.

6. The method recited in claim 1 wherein the container body forming step comprises:

extending the end walls and adjacent outer extremities of the side walls to a greater dimension from the bottom than the dimension of a central portion of the side walls; and forming a partially enclosing top panel extending across the end walls and between opposing outer extremities of the side walls.

7. The method recited in claim 6 wherein the container forming step comprises forming the bottom, the side walls and the partially enclosing top panels all from a continuous foldable sheet.

8. The method recited in claim 7 wherein the foldable sheet comprises corrugated boxboard.

9. The method recited in claim 7 further comprising the step of forming handle recesses in the opposing end walls.

10. The method recited in claim 6 further comprising the step of fixing the netting member only across the open portion of the top between the central portion of each side wall.

11. The method recited in claim 10 wherein the header sheet fixing step comprises adhering each header sheet across the corresponding outside face of the side wall, including the outer extremities thereof.

12. The method recited in claim 1 further comprising the step of forming a stacking tab at an upper extremity of each end wall.

13. The method recited in claim 12 further comprising the step of forming a recess at a lower extremity of each end wall for receiving the stacking tab of an adjacent container.

14. The method recited in claim 13 wherein the recess forming step comprises forming a handle opening in each end wall.

15. The method recited in claim 1 further comprising the step of forming recesses in the side walls for receiving the edges of the netting member therein.

16. A method for making a container for shipping and displaying articles, the method comprising the steps of:

folding and bending a continuous, foldable sheet of corrugated boxboard to form a container body having a bottom, enclosing end and side walls attached with and extending generally normal from the bottom and a partially enclosed top panel opposite the bottom and adjacent each end wall with a substantial portion of the top being open, the bottom and the end walls, side walls and the partial top panels defining an enclosure into which are placed the articles which are to be shipped and displayed;

filling the container with the articles to be shipped and displayed;

stretching a netting member having an open weave across the open portion of the top and between the top panels; and fixing opposing ends of the netting member to the container body.

17. The method recited in claim 16 wherein the netting member fixing step comprises the steps of:

attaching a header sheet to each opposing end of the netting member; and adhering each header sheet to an outside face of a side wall.

18. The method recited in claim 16 wherein the folding and bending step further comprises:

extending an overlapping panel of the continuous sheet from each end wall across a portion of the top to define the adjacent top panel, the overlapping panel further extending along adjacent outer extremities of the two side walls; and attaching the overlapping panel against the adjacent outer extremities of the side walls.

19. The method recited in claim 18 wherein the overlapping panel attaching step comprises applying an adhesive layer between each overlapping panel and the adjacent outer extremities of the side walls.

20. The method recited in claim 18 wherein the overlapping panel attaching step comprises:

forming a tab at each end of each overlapping panel; and inserting the tab into an opening along the adjacent side wall.

21. The method recited in claim 18 further comprising:

forming an elongated, central cut-out portion at an upper extremity of each side wall; and fitting the netting member only in each elongated central cut-out portion.

22. The method recited in claim 16 further comprising the steps of:

forming a partial cut at the interface between each overlapping panel and the adjacent end wall; and extending the uncut portion of the continuous panel in each partial cut generally parallel with the adjacent end wall to form a stacking tab.

23. The method recited in claim 22 further comprising the step of forming a handle cut-out at the interface of the bottom and each end wall.

24. The method recited in claim 23 further comprising the step of shaping the handle cut-out to receive the stacking tab.

25. The method recited in claim 16 wherein the folding and bending step further comprises extending a reinforcing panel from each outer extremity of each side wall in parallel relationship along an inside surface of each adjacent end wall.

26. The method recited in claim 25, further comprising attaching each reinforcing panel to the adjacent end wall.

27. The method recited in claim 16 further comprising the step of stretching the netting member only across a central portion of the open top.

28. The method recited in claim 27 further comprising the step of forming a cut-out along an upper extremity of each side wall across the central portion.

29. The method recited in claim 28 further comprising the step of forming recesses along sides of the cut-out for receiving edges of the netting member.

30. A container for shipping and displaying articles, the container comprising:

a container body having a bottom, enclosing end and side walls attached to and extending generally normal from the bottom and a top opposite the bottom at least a portion of which is open, the bottom and the end walls and side walls defining an enclosure into which are placed the articles to be shipped and displayed;

a netting member having a width dimensioned to extend across the open portion of the top and lengthwise ends dimensioned to extend across the open portion of the top and along outside faces of two opposing side walls;

two header sheets, each attached to a lengthwise end of the netting member and fixed to one of the outside faces of the side walls; and wherein each header sheet is fixed to an outside face of a side wall with an adhesive layer.

31. The container recited in claim 30 further comprising:

a netting end retention sheet fixed to an inside surface of each header sheet with a first layer of adhesive and with one lengthwise end of the netting member therebetween; and a second layer of adhesive between the netting and retention sheet and the outside face of the adjacent side wall.

32. A container for shipping and displaying articles, the container comprising:

a container body having a bottom, enclosing end and side walls attached to and extending generally normal from the bottom and a top opposite the bottom at least a portion of which is open, the bottom and the end walls and side walls defining an enclosure into which are placed the articles to be shipped and displayed;

a netting member having a width dimensioned to extend across the open portion of the top and lengthwise ends dimensioned to extend across the open portion of the top and along outside faces of two opposing side walls;

two header sheets, each attached to a lengthwise end of the netting member and fixed to one of the outside faces of the side walls; and wherein the end walls and outer extremities of the side walls extend to a greater dimension from the bottom than a central portion of the side walls, the container further comprising partially enclosing top panels extending across the end walls and between opposing outer extremities of the side walls.

33. The container recited in claim 32 wherein the bottom, the end walls, the side walls and the partially enclosing top panels are all formed from a continuous, foldable sheet.

34. The container recited in claim 33 wherein the foldable sheet comprises corrugated boxboard.

35. The container recited in claim 33 further comprising handle openings in the opposing end walls.

36. The container recited in claim 35 further comprising a stack tab extending from each end wall and dimensioned to fit within the handle opening of an adjacent container.

37. The container recited in claim 32 wherein the netting member is fixed only across the open portion of the top between the central portion of each side wall.

38. The container recited in claim 37 further comprising recesses on opposing sides of the central portion, with the sides of the netting member extending into the recesses.

39. The container recited in claim 32 wherein each top panel extends continuously from an adjacent end wall, each top panel including an overlapping panel extending along adjacent outer extremities of the two side walls and attached thereto.

40. The container recited in claim 32 further comprising a reinforcing panel extending from each outer extremity of each side wall in parallel relationship along an inside surface of each adjacent end wall and attached thereto.

41. The container recited in claim 33 wherein the container has a dimensional relationship between the outer extremities and the central portions relative to an article to be shipped therein which permits cross-ventilation.

* * * * *